US005528994A

United States Patent [19]

Iseli

[11] Patent Number: 5,528,994

[45] Date of Patent: Jun. 25, 1996

[54] CARDBOARD PALLET

[75] Inventor: Fredy Iseli, Uttwil, Switzerland

[73] Assignee: Swap-Lizenz AG, Gossau, Switzerland

[21] Appl. No.: 530,594

[22] Filed: Sep. 19, 1995

Related U.S. Application Data

[63] Continuation of Ser. No. 133,153, filed as PCT/CH93/00048, Feb. 24, 1993, published as WO93/16927, Sep. 2, 1993, abandoned.

[30] Foreign Application Priority Data

| | | | |
|---|---|---|---|
| Feb. 27, 1992 | [CH] | Switzerland | 626/92 |
| Aug. 6, 1992 | [DE] | Germany | 92 10 483 U |
| Oct. 12, 1992 | [DE] | Germany | 92 13 681 U |

[51] Int. Cl.[6] ..... B65D 19/00

[52] U.S. Cl. ..... 108/51.3

[58] Field of Search ..... 108/51.3, 56.3, 108/56.1, 51.1

[56] References Cited

U.S. PATENT DOCUMENTS

| | | | |
|---|---|---|---|
| 2,432,295 | 12/1947 | Donahue | 108/51.3 X |
| 2,493,562 | 1/1950 | Yarman . | |
| 2,503,240 | 4/1950 | Cahners | 108/51.3 |
| 2,728,545 | 12/1955 | Hermitage | 108/51.3 |
| 3,006,590 | 10/1961 | Hoag | 108/51.3 |
| 3,780,929 | 12/1973 | Terrassi . | |
| 5,076,176 | 12/1991 | Clasen | 108/51.3 |
| 5,269,219 | 12/1993 | Juvik-Woors | 108/56.3 X |
| 5,329,861 | 7/1994 | McCarthy | 108/51.3 |

FOREIGN PATENT DOCUMENTS

| | | |
|---|---|---|
| 0084906 | 8/1983 | European Pat. Off. . |
| 0283799 | 9/1988 | European Pat. Off. . |
| 1346462 | 11/1963 | France . |
| 697232 | 9/1963 | United Kingdom . |

*Primary Examiner*—Jose V. Chen

*Attorney, Agent, or Firm*—Fish & Neave; Jeffrey H. Ingerman

[57] ABSTRACT

The pallet consists of a plate (1), at least four feet (2) glued to the bottom side of the plate (1) and at least two laths (3) glued to in each case at least two feet (2). The plate (1) has a plate core of corrugated cardboard, the longitudinal direction of the corrugations of said cardboard extending preferably perpendicular to the plane of the plate, and a plate wrapping preferably of gray cardboard which wraps around all end surfaces. The feet (2) contain corrugated cardboard with the corrugations extending perpendicular to the plane of the plate. The laths (3) are constructed analogous to the plate (1). The pallet is stable and can be produced in standard dimensions.

10 Claims, 6 Drawing Sheets

CARDBOARD PALLET

This is a continuation of application No. 08/133,153, filed as PCT/CH93/00048, Feb. 24, 1993, published as WO93/16927, Sep. 2, 1993, entitled CARDBOARD PALLET, now abandoned.

BACKGROUND OF THE INVENTION

It has already been proposed on various occasions to make pallets from corrugated cardboard. Such a proposal is contained, for example, in European Patent application D 283 799. However, until now such pallets have not proved successful in practice, either because they are not stable enough or, as for example those according to European Patent application D 283 799, they do not have dimensions that correspond to the norm.

SUMMARY OF THE INVENTION

It is the object of the present invention to make a pallet from cardboard in such a way that it is stable and can also be produced in the standard dimensions. This object is achieved by the combination of the features of the invention, in accordance with which there is provided a cardboard pallet having a plate, at least four rectangular feet, and at least two laths. The plate has a plate core of cardboard with plate covers of cardboard that form the upper side and underside of the plate. The feet are made of cardboard having corrugations perpendicular to the plane of the plate and are glued to the underside of the plate. Each lath is glued to the undersides of at least two feet and have a lath core of cardboard and a lath cover of cardboard.

A plate for such a pallet is also provided.

BRIEF DESCRIPTION OF THE DRAWINGS

In the following exemplified embodiments of the invention will be explained with reference to the drawings, wherein.

DETAILED DESCRIPTION OF THE INVENTION

Figure 1:
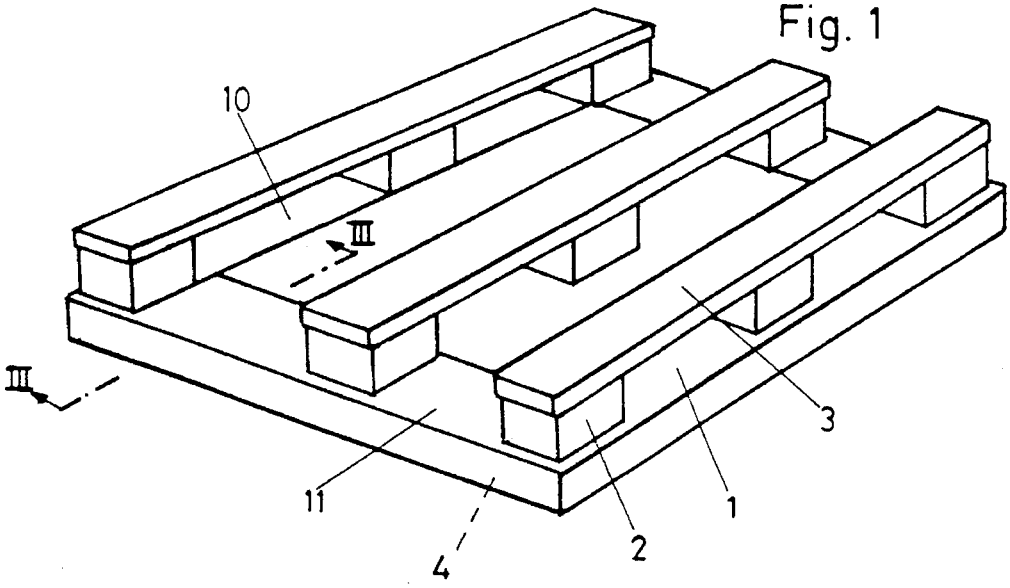
FIG. 1 is a perspective view of the underside of a pallet.

The pallet illustrated in FIG. 1 consists of a flat, rectangular plate 1, nine feet 2 glued to the underside of the plate 1, and three laths 3, each glued to the underside of three feet.

Figure 3:
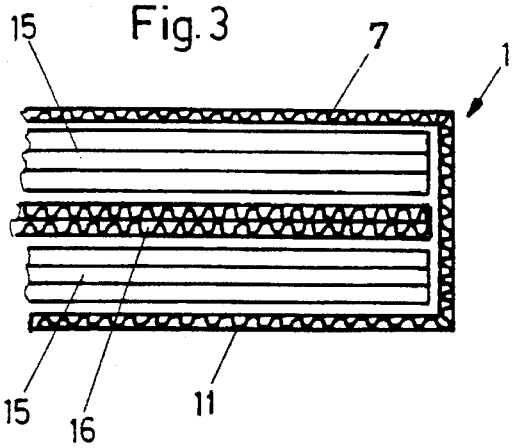
FIG. 3 shows a cross-sectional view along line III—III in FIG. 1.

The plate 1 consists of three sandwiched and glued together rectangular corrugated cardboard blanks 15, 16 and of a further blank 7 as a cover (FIG. 3). The longitudinal direction of the corrugations of the middle blank 16 and of the cover blank 7 extend transverse to the longitudinal direction of the plate 1, those of the blanks 15 parallel thereto. The blanks 15 consist of triple-corrugation cardboard and are about 12 mm thick, the blank 16 consists of double-corrugation cardboard and is about 10 mm thick. The cover blank consists of single-corrugation cardboard and is only about 3 mm thick. The overall thickness of the plate 1 is about 35 mm.

Figure 2:
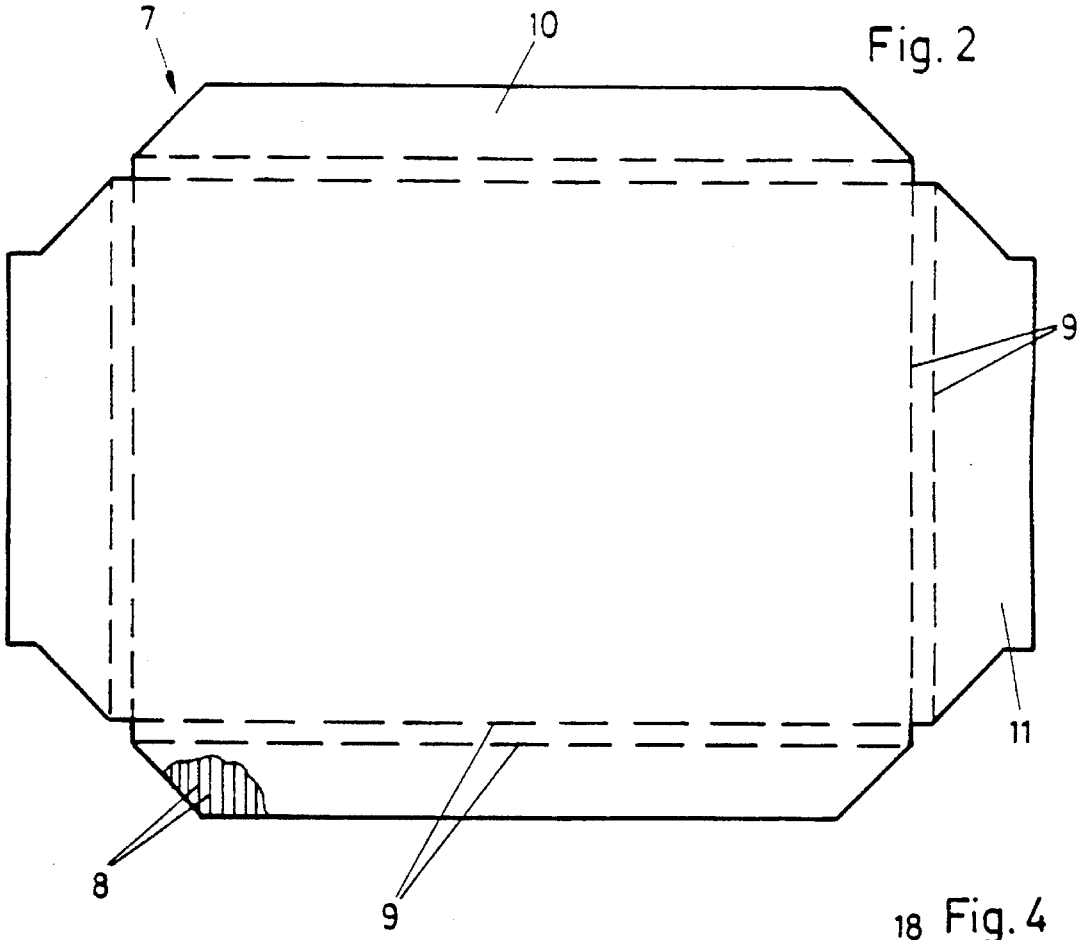
FIG. 2 shows a blank for a pallet.

As shown in FIG. 2 and 3, the cover blank 7 has flaps 10, 11 delimited by fold-lines 9 stamped in pairs, which project beyond the edges of the blanks 15, 16, are folded up along the faces thereof and glued to the underside 5 of the plate 1 (FIG. 3). The length of the broad-side flap 11 glued onto the underside 5 corresponds at least to the length of the feet 2, and the width of the long-sided flap 10 at least to the width of the feet 2. The entire outside surface of the plate 1 is coated with the same water based, waterproof glue with which the blanks 15, 16, 7 are glued together. As a result thereof a waterproof impregnation is obtained without using foreign materials. This type of impregnation furthermore has the advantage that the glue inside the corrugated cardboard layers and between adjacent layers is not adversely affected by solvents, as is the case, for example, when varnishing with the usual varnishes. The faces of the plate 1 are sealed so that no water or foreign substances can penetrate into the corrugations of the layers 15, 16. Because of the cross-wise layer construction the plate 1 is resistant to bending in both directions. Alternatively, also a water based varnish can be used for the impregnation.

The laths 3 are made from blanks 22, 18 (FIG. 4) in the same way as the plate 1, except that here the intermediate layer 16 has been left out. With the two rectangular, triple-corrugation cardboard blanks 22 the corrugations 23 extend longitudinally, those of the single-corrugation, thin cover blank 18 transversely. The folded over flaps 21 of the blank 18 here cover the entire upper side of the lath 3. The surface of the laths 3 is impregnated with glue in the same manner.

Figure 5:
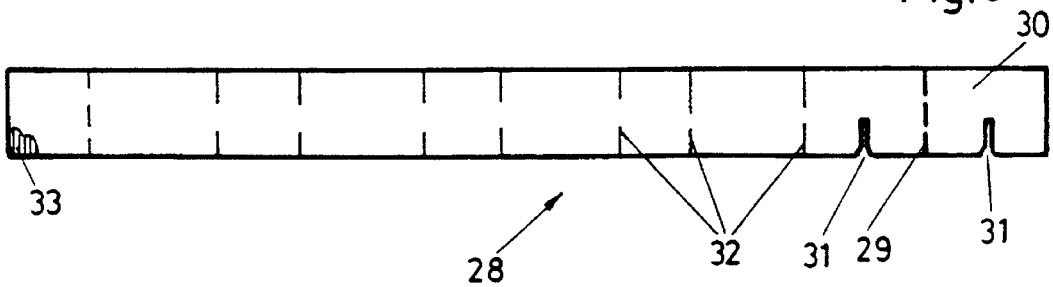
FIG. 5 shows a blank for a foot.

FIG. 5 shows a blank 28 for a foot 2. It consists of double-corrugation cardboard, is rectangular and at one end has a separating cut 29 for cutting off a section 30, as well as eight fold-lines 32. The corrugations 33 extend transverse to the longitudinal direction of the blank 28. In the middle of the section 30 and of the adjoining part incisions 31 are provided up to half the width of the blank 28.

Figure 6:
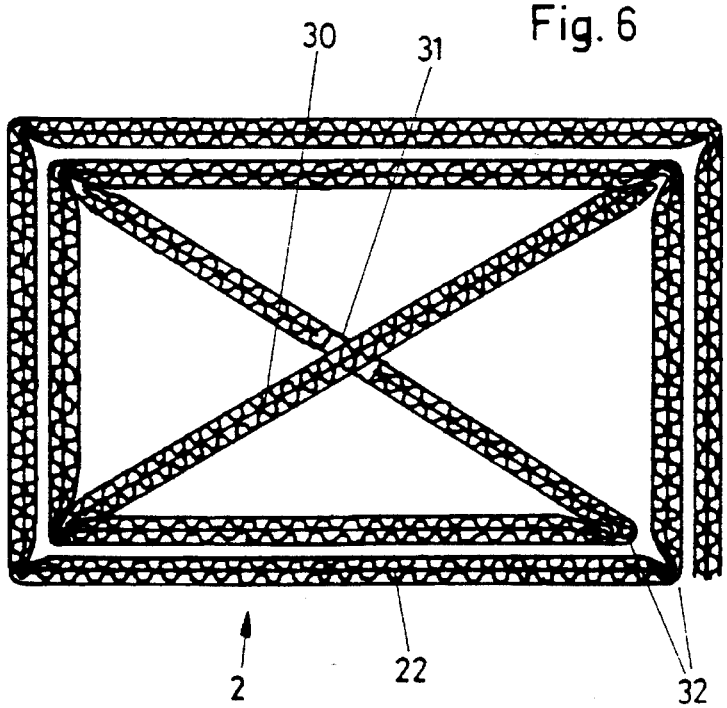
FIG. 6 is a transverse cross-sectional view of a folded foot.

FIG. 6 shows a transverse cross-sectional view of the folded foot. The last part and the inserted section 30 serve as diagonal reinforcing. The walls of the foot 2 are glued right around in two layers. The feet 2 are also impregnated with glue.

The described pallet is strong and waterproof and can be produced with the existing standard dimensions, e.g. as a Euro-pallet with the dimensions 120 cm×80 cm or 60 cm×80 cm. The pallet is type-pure and consists exclusively of paper and glue. As a result thereof it can readily be reused and recycled. The pallet with a mass of about 12 kg (at 120×80 cm) is very much lighter than corresponding wooden pallets which weigh about 25 kg. This considerably simplifies the handling of the empty pallets. Because of its sturdiness the pallet can be used as a multiple-use pallet.

For special uses the plate 1 may, for example, also be made hexagonal.

Figure 7:
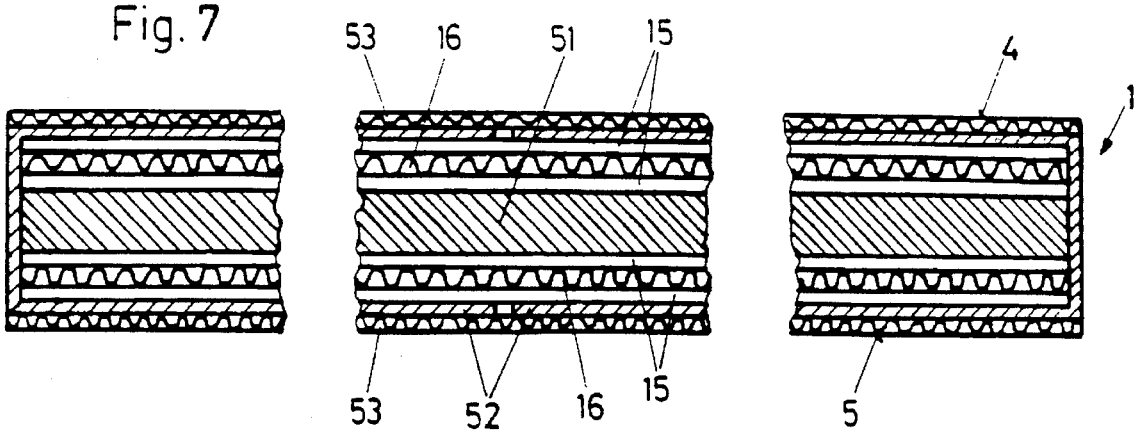
FIG. 7 is a section similar to FIG. 3 through a second embodiment.
Figure 8:
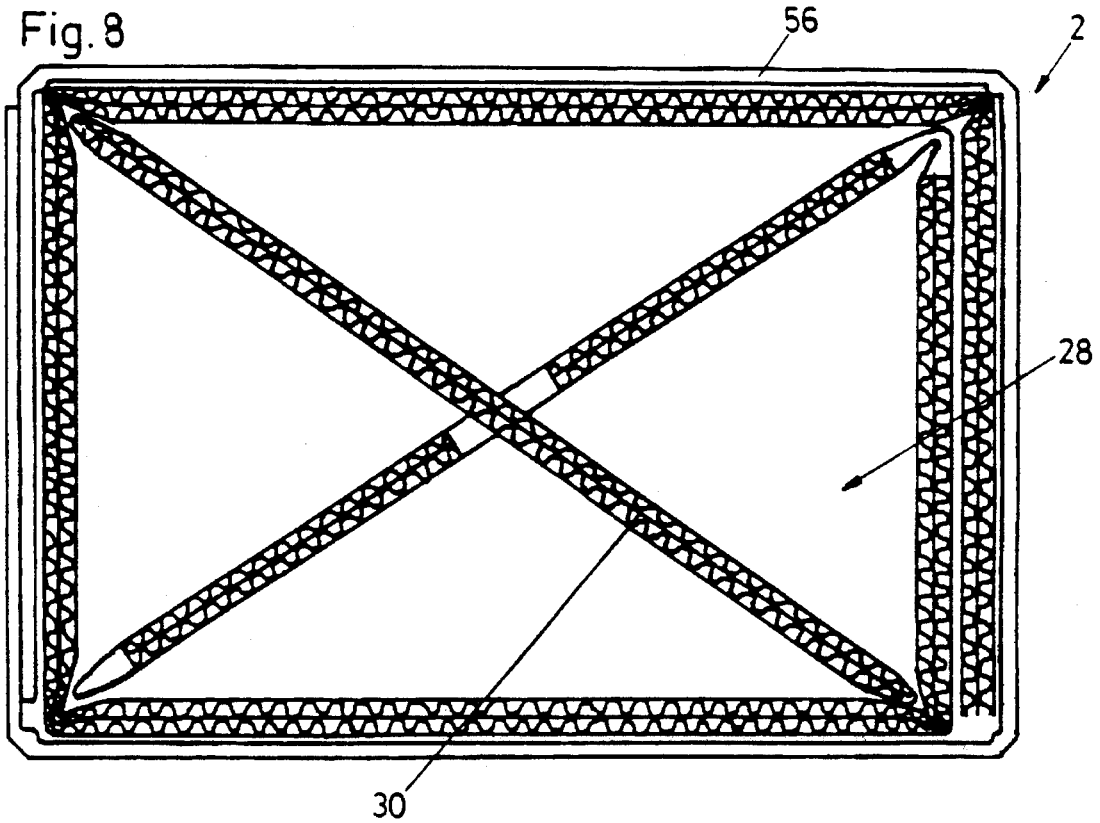
FIG. 8 is a transverse cross-sectional view of the foot of the second embodiment.
Figure 9:
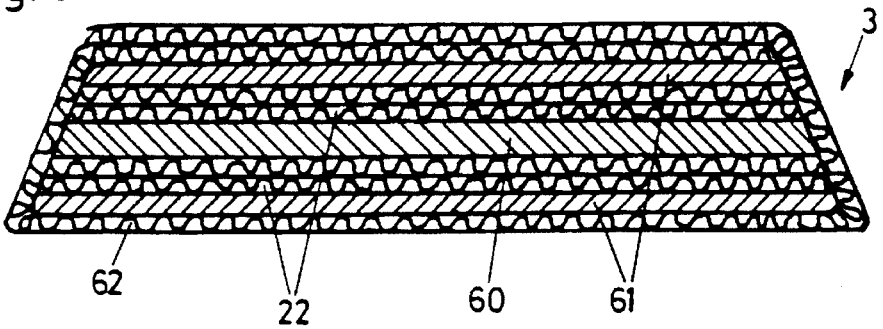
FIG. 9 is a cross-section through the lath of the second embodiment.

With the embodiment according to FIG. 7 to 9 identical parts have been given the same reference numerals, so that it is not necessary to give a detailed description of these parts. The embodiment according to FIG. 7 to 9 differs from that according to FIG. 1 to 6 with regard to the construction of the plate 1, the feet 2 and the laths 3. The plate 1 according to FIG. 7 has a centrally arranged blank 51 of solid cardboard and on either side thereof a total of three alternatingly sandwiched, single-corrugation blanks 15, 16. The cover is formed by two inner rectangular blanks 52 of solid cardboard, each of which covers half of the upper side and underside as well as the narrow faces, and an outer rectangular blank 53 of single-corrugation cardboard which on the upper side 4 is continuous, envelopes the long faces, and the narrow edges of which butt against one another in the middle on the underside.

This construction of the plate 1 has, compared to that of FIG. 1 and 3, the advantages that because of the solid cardboard layers it is more impact resistant to shocks from the side, as well more puncture resistant in respect of sharp objects. The rectangular blanks 52, 53 have only parallel fold-lines and can be produced more easily.

The foot according to FIG. 8 differs from that of FIG. 6 in that the blank 28 overlaps on only one narrow side, and in that in addition it comprises a blank 56 of solid cardboard which also increases the impact resistance. Tests have shown that the blank 28 in the form illustrated in FIG. 8 can easily be struck, unglued, into the glued cover blank 56. The gluing of the foot 2 to the plate 1 and the lath 3 gives it sufficient stability.

Figure 4:
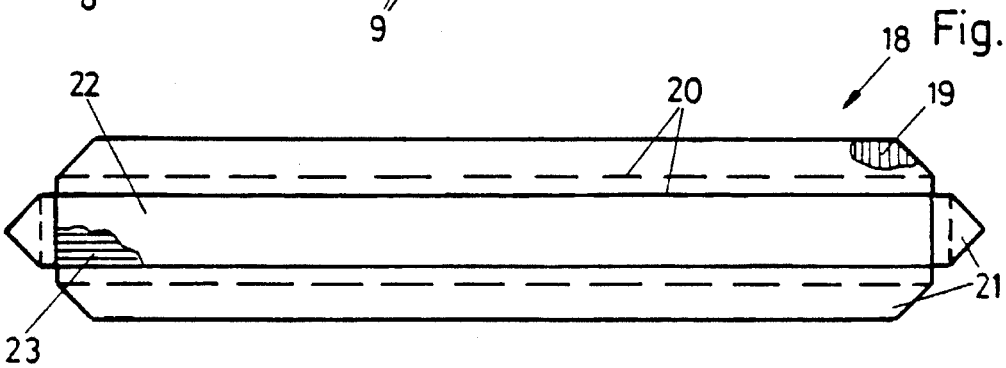
FIG. 4 shows a blank for a lath.

The lath 3 according to FIG. 9 differs from that of FIG. 1 and 4 in that it has a construction similar to that of the plate 1 according to FIG. 7, except that all corrugated cardboard layers have longitudinally directed corrugations. Also provided is a middle blank 60 of solid cardboard as well as an inside cover blank 61 of solid cardboard. This envelopes the narrow faces. The outer cover blank 62 of single-corrugation cardboard is on the upper side overlapped over its entire surface. The solid cardboard layers 60, 61 also increase the impact resistance. The face ends of the cover blank 62 are advantageously squashed flat during the gluing to close the corrugations of this blank at the faces. The cross-section of the lath 3 according to FIG. 9 is trapezoidal. This has the advantage that the rollers of a pallet truck can more easily move over the lath 3.

Figure 10:
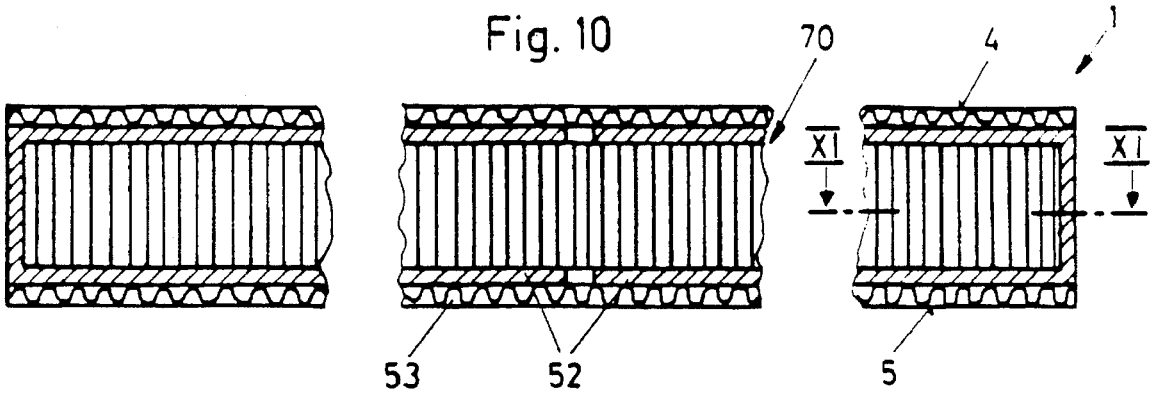
FIG. 10 is a cross-section similar to FIG. 3 through a third embodiment of a plate.
Figure 11:
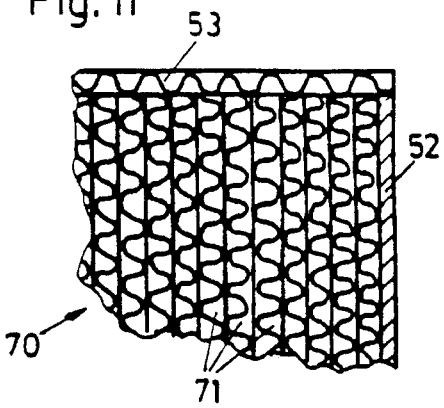
FIG. 11 shows a section along line XI—XI in FIG. 10.

The plate 1 according to FIG. 10 and 11 consists of a core 70 of glued together, single corrugation, one-sided corrugated cardboard 71, the corrugations of which extend perpendicularly to the plane of the plate, i.e. to the upper side 4 and underside 5, as well as of a cover 52, 53, which is constructed the same as the cover 52, 53 of the embodiment according to FIG. 7. The corrugated cardboard 71 of the core 70 may consist of 100% old paper. It may in addition be impregnated with a flame-inhibiting and/or a water-repelling agent. Advantageously it is first made as a large block and then sawn into slices according to the required core thickness, e.g., by means of a bandsaw.

It has been found that with the plate construction according to FIG. 10 and 11, in which the core 70 acts as a honeycomb structure, a very high bending resistance can be obtained at a lesser mass than with the embodiment according to FIG. 7. In addition the embodiment according to FIG. 10 and 11 can be produced even more economically.

The core construction according to FIG. 10 and 11 can also be used for the feet 2 in that with the embodiment according to FIG. 8 the blank 28 is replaced by a core corresponding to the core 70 of FIG. 10 and 11.

Figure 12:
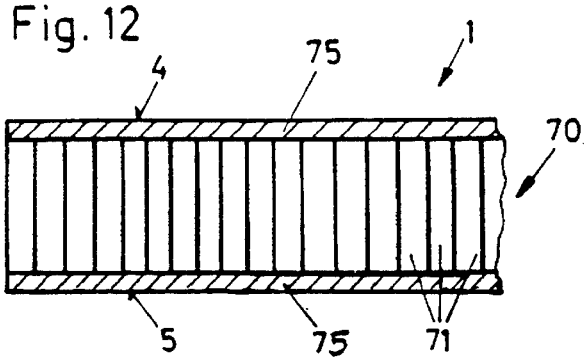
FIG. 12 shows a variant of the plate according to FIG. 10.

The embodiment according to FIG. 12 is intended mainly for economically priced disposable pallets. In this case only a gray cardboard 75 is glued to the upper side and the underside of the core 70. The faces of the core 70 are not covered.

The laths 3 can either be constructed the same as with the embodiment according to FIG. 9, or they may also have the honeycomb structure according to FIG. 10. Preferably, the laths 3 have the trapezoidal cross-section shown in FIG. 9.

The cardboard sandwich construction according to FIG. 12 is also suitable for other applications, e.g., for stable cardboard cases. With this application the cover blanks 75 may also both consist of corrugated cardboard. These sandwich plates with a honeycomb core have at a low mass a high strength and rigidity. In addition the honeycomb core 70 offers good protection against knocks as it forms a crusher zone.

Figure 13:
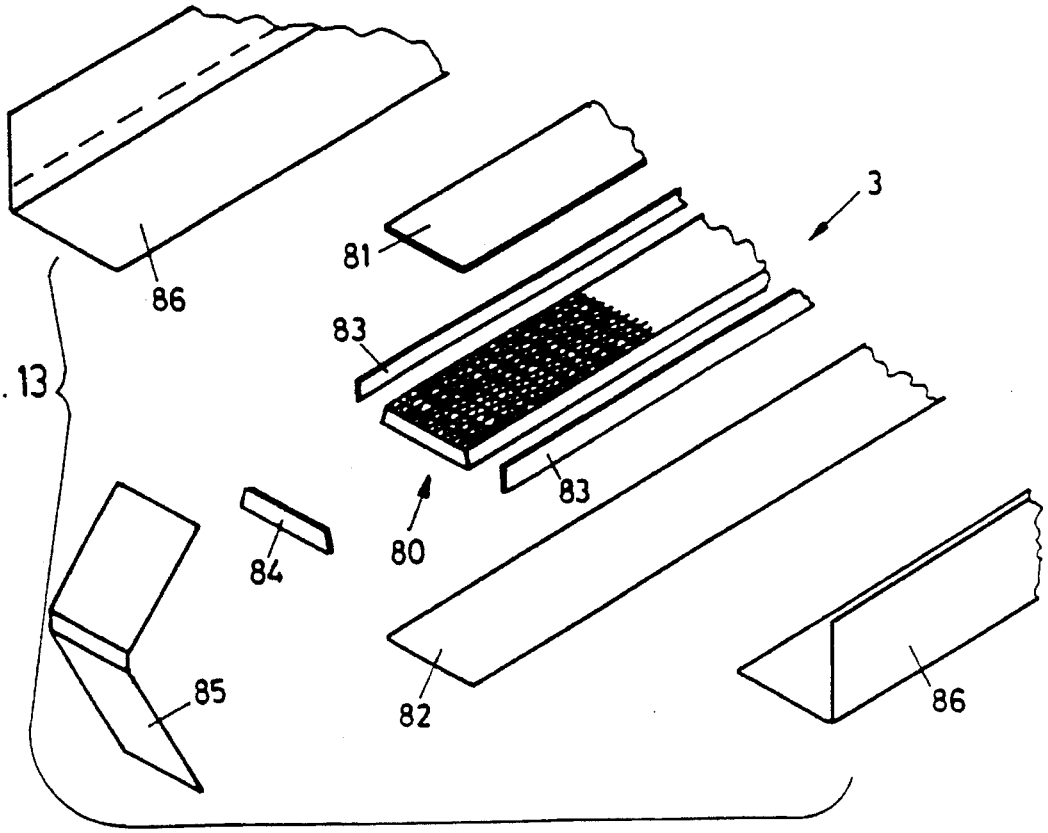
FIG. 13 shows a further embodiment of the lath.

In FIG. 13 a further embodiment of the lath 3 is shown in perspective in its detail parts. The core 80 of the lath 3 is constructed the same as the core 70 of the plate 1 according to FIGS. 10, 11 and 12, i.e., with corrugations which all extend perpendicularly to the plane of the plate. It has trapezoidal cross-section. Glued onto the upper side and the underside of the core 80 are solid cardboard blanks 81, 82. Glued onto the two narrow sides and the faces of the core 80 and the blanks 81, 82 are laths 83, 84 of solid cardboard. In this way the entire core 80 is enveloped in solid cardboard. Next a blank 85 of kraft paper is folded around each of the faces and glued on. Finally, also the upper side and underside as well as the narrow sides are still covered with two rectangular kraft paper blanks 86. Subsequently, the faces are expediently dipped in a relatively viscous glue bath with waterproof glue. By doing so the two short faces are sealed.

Figure 14:
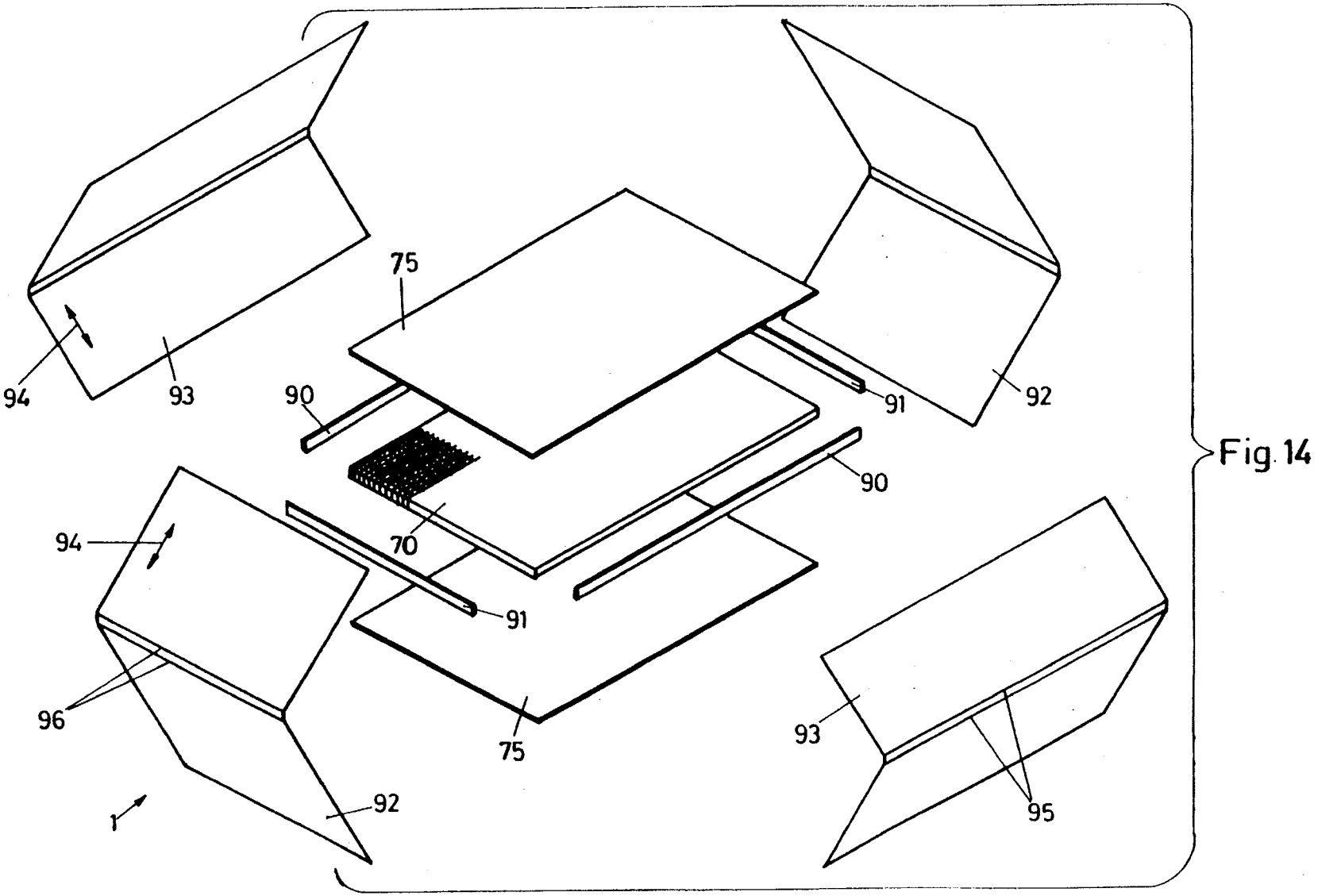
FIG. 14 shows a further embodiment of the plate.
Figure 15:
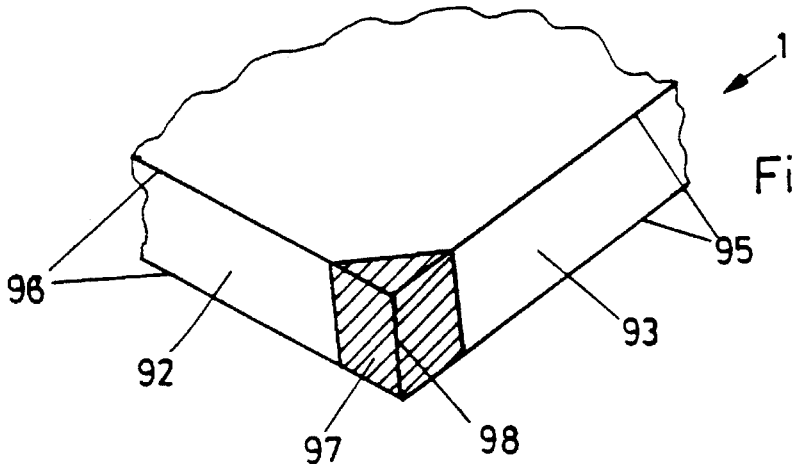
FIG. 15 is a partial view of the plate according to FIG. 14.

The plate 1 according to FIG. 14 is constructed the same as the lath 3 according to FIG. 13: The plate core 70 is the same as that of FIGS. 10–12. A solid cardboard blank 75 is glued onto both sides of this core 70. Then strips 90, 91 of solid cardboard are glued onto all the faces of the core 70 and blanks 75. As a result thereof also here the entire core 70 is enveloped in solid cardboard. The cover is completed by four glued on, rectangular kraft paper blanks 92, 93 which encase the longitudinal edges 95 and the broad edges 96 and each cover half of the upper side and underside. The fibre directions 94 of the blanks 92, 93 cross one another. The kraft paper of the blanks 92, 93 has a relatively high cellulose content of 70–90 percent and an area mass of about 0.3 kg per m2. As a result thereof it has a high tensile strength. This results for the plate 1 according to FIG. 14 in a high bending resistance at a low mass. To seal the short corner edges 98, the corners of the plate 1 according to FIG. 14 are dipped in a waterproof, relatively viscous glue. This results in a sealing layer 97, which is indicated in FIG. 15.

The pallet with the plate 1 according to FIG. 14, the feet 2 according to FIG. 8 and the laths 3 according to FIG. 13 is preferably also impregnated with a waterproof glue or a water based varnish. At the same mass it has a higher carrying capacity and impact resistance than the pallet according to FIGS. 1–6.

Figure 16:
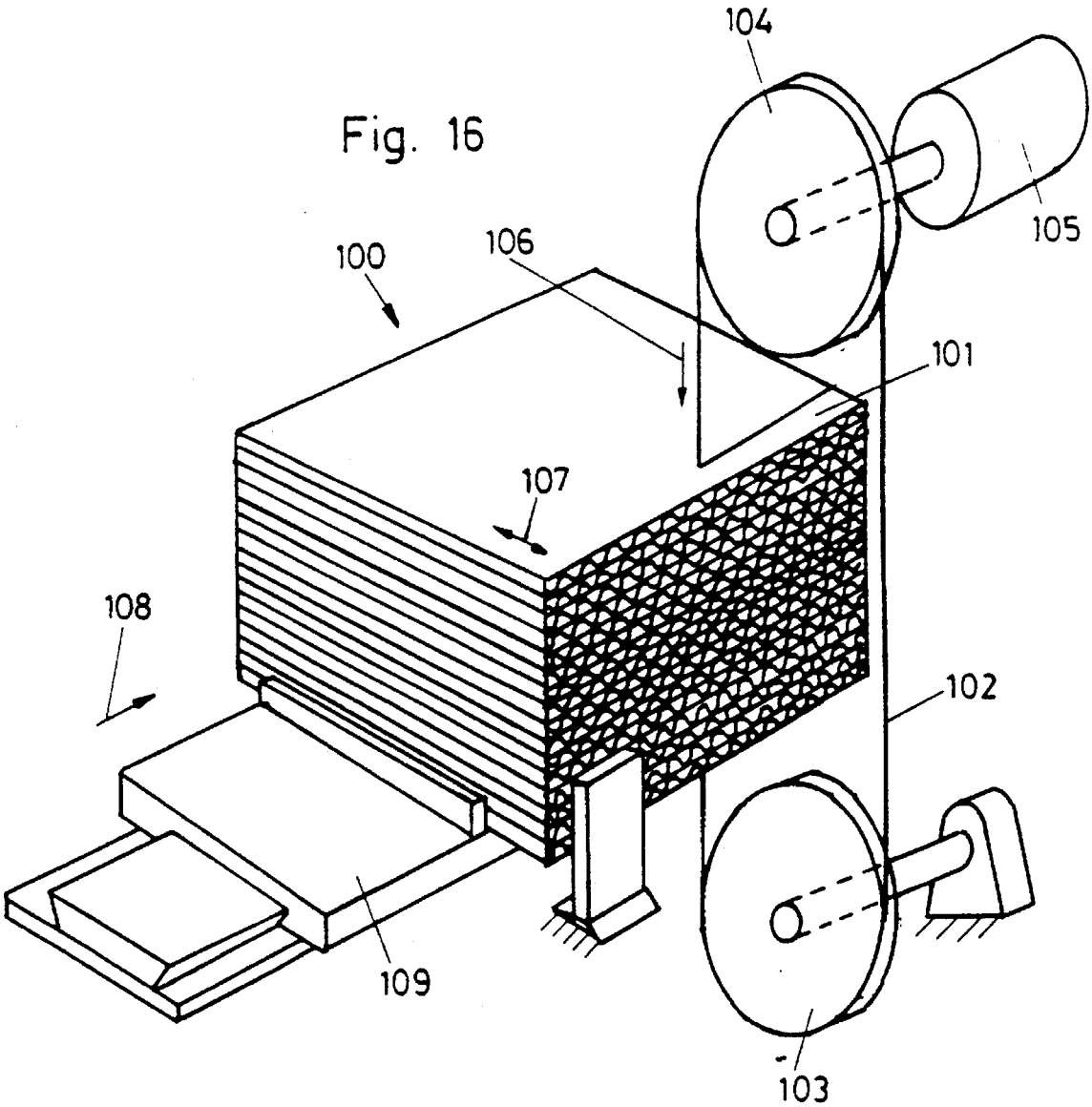
FIG. 16 is a diagrammatic representation of the manufacture of the core of a plate or lath.

FIG. 16 illustrates diagrammatically the making of the core 70 or 80 for the plate 1 according to FIGS. 10 and 11 or 12 or 14 and for the lath 3 according to FIG. 13. First rectangular, single corrugation, one-sided corrugated cardboard blanks are glued together, all corrugations extending in the same direction. This results in a large block 100. The block 100 is then sawn into slices 101. For sawing, a thin wire 102 of, for example, 0.5 mm diameter coated with hard substance grains, preferably with diamond, is used. The wire is guided over two deflection rollers 103, 104, one roller 104 being driven by a motor 105. The cutting side 106 of the wire 102 is perpendicular to the corrugation direction 107 of the corrugated cardboard blanks and perpendicular to the feed direction 108 of a carriage 109 on which the block 101 is clamped in.

This type of core manufacture is very economical. Because of the thin, diamond-coated wire 102 only very little cutting waste is produced.

I claim:

1. A cardboard pallet comprising:

a rectangular plate having longitudinal edges and transverse edges and comprising a plate core of single-row, one-sided corrugated cardboard layers having end faces, said corrugated cardboard layers being glued together and the corrugations of which extend in their entirety perpendicularly to the plane of said plate;

a blank of solid cardboard glued to each of the upper side and the underside of said core, each of said solid cardboard blanks having four end faces;

strips of solid cardboard glued onto all end faces of said core and of said solid cardboard blanks;

at least one cover of kraft paper folded around all longitudinal and transverse edges of said solid cardboard blanks and strips so as to cover said solid cardboard blanks;

at least four rectangular feet glued to said underside of said plate, said feet comprising corrugated cardboard; and at least two laths glued to the underside of at least two feet each, each of said laths having two end faces and comprising a lath core of cardboard.

2. The pallet of claim 1, wherein said edges of said plate are sealed with a waterproof glue.

3. The pallet of claim 1, wherein:

said feet each comprise a core of corrugated cardboard and a foot cover of solid cardboard folded around said core;

the corrugations of said foot core extend perpendicularly to the plane of said plate; and each of said feet is glued directly to said plate and said laths.

4. The pallet of claim 1 wherein each of said laths further comprises a lath cover comprising solid cardboard blanks glued to the upper side and underside of said lath core and to all said end faces, and at least one cover of kraft paper which encases at least the longitudinal edges of said lath.

5. The pallet of claim 4, wherein at least two end faces of each lath are sealed with waterproof glue.

6. The pallet of claim 1, wherein said laths have a trapezoidal cross-section.

7. The pallet of claim 1, wherein said plate, said feet and said laths are impregnated in a waterproof manner.

8. The pallet of claim 7 wherein said plate, feet, and laths are impregnated with a waterpoof glue.

9. The pallet of claim 7 wherein said plate, feet, and laths are impregnated with a water based varnish.

10. A rectangular plate of cardboard comprising:

a core of single-row, one-sided corrugated cardboard layers which are glued together and the corrugations of which extend in their entirety perpendicular to the plane of the plate; and a blank of solid cardboard glued to each of the upper side and bottom side of said core; wherein:

said core and blanks have four end faces, said plate further including strips of solid cardboard glued on all four end faces of said core and blanks; and said plate further comprises kraft paper blanks wrapped around said cardboard blanks and said strips, said kraft paper blanks being folded around all longitudinal and transverse edges of said plate.

* * * * *